US007547862B2

(12) United States Patent
Kim et al.

(10) Patent No.: US 7,547,862 B2
(45) Date of Patent: Jun. 16, 2009

(54) ELECTRIC OVEN

(75) Inventors: Yang Kyeong Kim, Bucheon-si (KR); Jae Kyung Yang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/615,370

(22) Filed: Dec. 22, 2006

(65) Prior Publication Data

US 2007/0158330 A1 Jul. 12, 2007

(30) Foreign Application Priority Data

Dec. 22, 2005 (KR) ..... 10-2005-0127586

(51) Int. Cl.
*A21B 1/00* (2006.01)
*F24C 15/02* (2006.01)

(52) U.S. Cl. ..... 219/400; 219/391; 219/681; 219/411; 219/685; 219/402; 126/193; 126/200; 126/198; 126/21 A; 126/273 R

(58) Field of Classification Search ..... 219/391, 219/400, 411, 681, 685, 402; 126/193, 200, 126/196, 21 A, 273 R
See application file for complete search history.

(56) References Cited

U.S. PATENT DOCUMENTS

| | | | | |
|---|---|---|---|---|
| 4,096,369 | A * | 6/1978 | Tanaka et al. | 219/741 |
| 5,387,258 | A * | 2/1995 | Puricelli | 126/21 A |
| 7,060,940 | B2 * | 6/2006 | Kim et al. | 219/400 |
| 7,126,097 | B2 | 10/2006 | Kim et al. | |
| 2007/0029312 | A1 | 2/2007 | Kim et al. | |

OTHER PUBLICATIONS

U.S. Appl. No. 11/609,480 to Kim et al., filed Dec. 12, 2006.

* cited by examiner

*Primary Examiner*—Shawntina Fuqua
(74) *Attorney, Agent, or Firm*—Greenblum & Bernstein, P.L.C.

(57) ABSTRACT

An electric oven includes a housing having a cooking chamber for cooking food and a component chamber containing components for operating the electric oven. A door is provided on a front of the housing for selectively opening and closing the cooking chamber. A suction duct introduces external air from outside of the housing into the component chamber, and an exhaust duct with a sloped portion discharges air from the component chamber to outside of the housing.

19 Claims, 4 Drawing Sheets

ELECTRIC OVEN

This application claims the benefit of the Patent Korean Application No. 10-2005-0127586, filed on Dec. 22, 2005, which is hereby incorporated by reference in its entirety.

BACKGROUND OF THE INVENTION

1. Field of the Invention

The present invention relates to electric ovens, and more particularly to an electric oven which has a flow passage that can prevent exhaust from discharging toward a front of a door, and prevent high temperature and high pressure air from discharging toward a user from a cooking chamber.

2. Discussion of the Related Art

In general, oven ranges are broadly categorized as electric oven ranges and gas oven ranges. Electric ovens are appliances for heating various kinds of food in the oven by using a heater generating heat with electricity (such as, for an example, ceramic heaters, sheath grill heaters, halogen heaters).

Particularly, the electric oven range is popular to consumers owing to advantages of a high cooking speed, high heat efficiency, and as being safer than gas oven range from fire because the electric oven range does not produce flame.

In a cooking chamber of the an electric oven, there is dirt, such as foreign matter, oil, and the like, accumulated thereon during cooking. Accordingly, electric ovens are provided with an automatic cleaning function for removing the foreign matter, oil, and the like, accumulated on the chamber at predetermined intervals, or on a user's selection.

In an automatic cleaning mode, the heater is operated to heat the inside of the cooking chamber higher than a certain level, to elevate a temperature of the inside of the cooking chamber higher than 450° C., which is higher than a regular cooking case, to carbonize and remove the oil and the like from the cooking chamber.

The user may then remove the dirt from the cooking chamber manually, or put an automatic cleaning function into operation.

In the meantime, since the heat generated in the cooking chamber of the electric oven is transmitted to an outside of a door through the door and glass on the door, an outside surface of the door can be heated to a temperature high enough to bum a user's hand if the user touches the door during operation of the electric oven.

Particularly, because the temperature inside of the cooking chamber rises higher than 450° C. in the automatic cleaning mode, the outside surface of the door can also be heated to a high temperature of about 90° C.

Therefore, the related art electric oven cools the door for preventing the door from being heated high enough to burn a user's hand.

Multiple layers of glass sheets are provided to an inside of the door, and passages are formed for drawing external air through the inside of the door. As cold external air keeps flowing through the door during operation of the electric oven the door is cooled.

Over the cooking chamber of the related art electric oven, there is a component chamber for mounting various electric components required for operation and control of the electric oven. Air which is discharged after cooling the component chamber is discharged forward through an upper side of the door.

If the user comes close to the door during or after cooking, the user is liable to feel uncomfortable with hot exhaust from the door. Along with this, the direct discharge of the high temperature, high pressure air from the cooking chamber to the user is liable to make the user feel unpleasant, and produces a safety problem since a user can be burnt.

This results in customer complaints and deteriorates product reliability.

SUMMARY OF THE INVENTION

Accordingly, the present invention is directed to an electric oven which avoids the above-noted problems.

An object of the present invention is to provide an electric oven range in which a flow direction of high temperature exhaust from the electric oven range is changed, to have a flow passage that does not discharge the exhaust forward.

Another object of the present invention is to provide an electric oven range which can prevent the user form being exposed to high temperature air from a cooking chamber even when the user opens the door.

Additional advantages objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a electric oven includes a housing having a cooking chamber for cooking food and a component chamber containing components for operating the electric oven, a door on a front of the housing for selectively opening and closing the cooking chamber, a suction duct for introducing external air from outside of the housing into the component chamber, and an exhaust duct having a sloped portion for discharging air from the component chamber to outside of the housing.

The door may include an air flow passage, the air flow passage having one end in communication with the exhaust duct. The exhaust duct supplies air toward the air flow passage when the door is in a closed condition, and supplies air toward a front of the cooking chamber when the door is in an opened condition.

The door may include an inlet air flow passage for drawing in external air, and a discharge air flow passage for discharging air. The exhaust duct supplies air toward the discharge air flow passage when the door is in a closed condition and supplies air toward a front of the cooking chamber when the door is in an opened condition. The inlet air flow passage supplies external air to the suction duct.

The door may include glass sheets between which the inlet air flow passage and the discharge air flow passage are formed. The door may further include a sealed air chamber.

The component chamber may be positioned above the cooking chamber. The suction duct and the exhaust duct may be located within the component chamber. The electric oven may farther include a fan in the component chamber for introducing air into the component chamber through the suction duct, and for discharging air from the component chamber through the exhaust duct.

In another aspect of the present invention, an electric oven includes a housing having a cooking chamber for cooking food and a component chamber containing components for operating the electric oven, a door on a front of the housing for selectively opening and closing the cooking chamber, and an exhaust duct for discharging air from the component chamber to outside of the housing, the door including an air flow passage, the air flow passage having one end in communication with the exhaust duct.

The exhaust duct supplies air toward the air flow passage when the door is in a closed condition, and supplies air toward a front of the cooking chamber when the door is in an opened condition.

The electric oven may further include a suction duct for introducing external air from outside of the housing into the component chamber, the suction duct and the exhaust duct being located within the component chamber.

The electric oven may further include a fan in the component chamber for introducing air into the component chamber through the suction duct, and for discharging air from the component chamber through the exhaust duct.

In another aspect of the present invention, an electric oven includes a housing having a cooking chamber for cooking food and a component chamber containing components for operating the electric oven, and a door on a front of the housing for selectively opening and closing the cooking chamber, the door including an inlet air flow passage for drawing in external air, and a discharge air flow passage for discharging air.

The electric oven may further include a suction duct for introducing external air from outside of the housing into the component chamber, and an exhaust duct for discharging air from the component chamber to outside of the housing. The exhaust duct supplies air toward the discharge air flow passage when the door is in a closed condition, and supplies air toward a front of the cooking chamber when the door is in an opened condition. The inlet air flow passage supplies external air to the suction duct.

The electric oven may further include a fan in the component chamber for introducing air into the component chamber through the suction duct, and for discharging air from the component chamber through the exhaust duct.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. Wherever possible, the same reference numbers will be used throughout the drawings to refer to the same or like parts.

Figure 1:
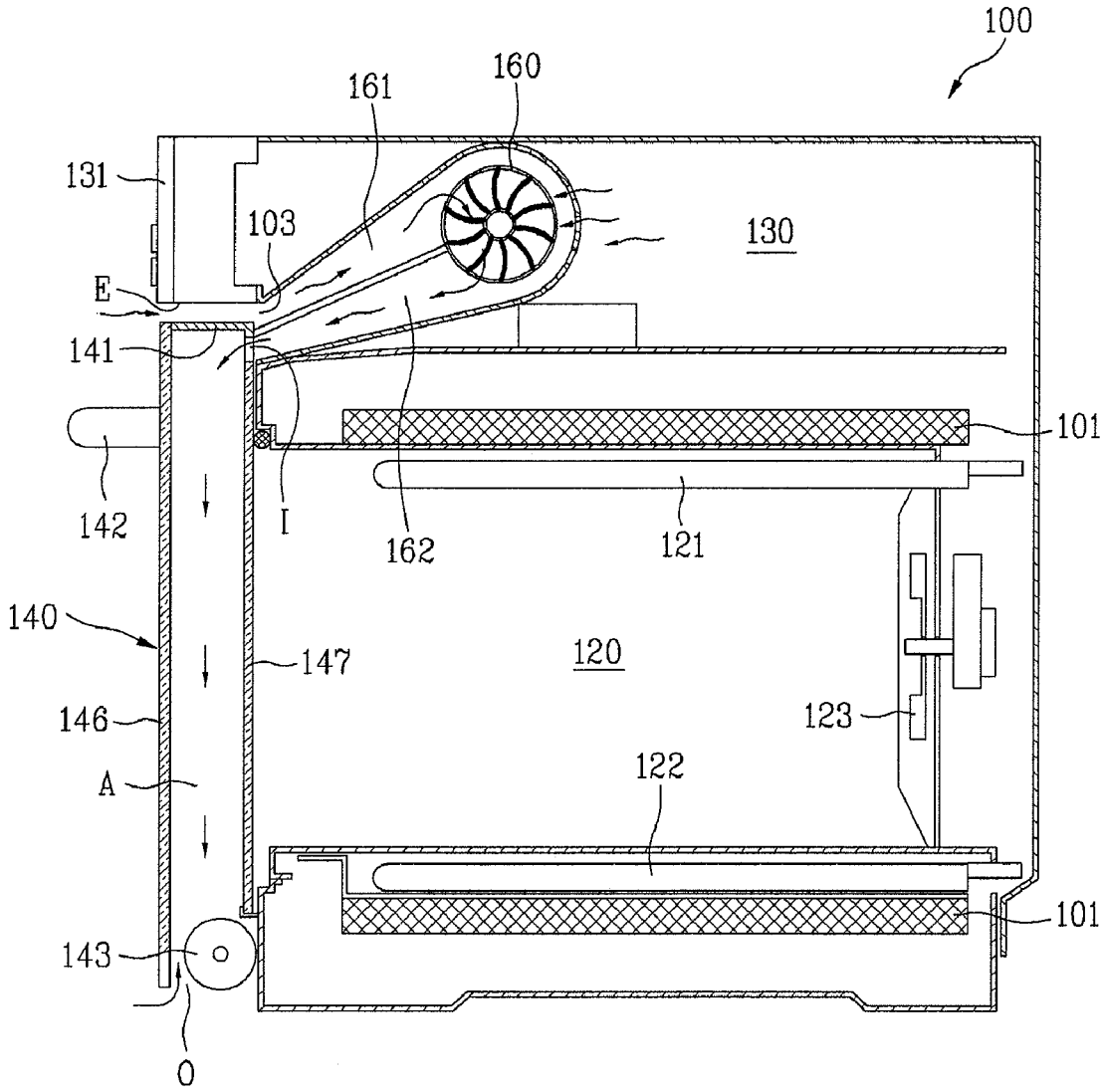
FIG. 1 is a longitudinal sectional view of an electric oven in accordance with a first embodiment of the present invention.

Referring to FIG. 1, the electric oven includes a housing 100 forming an exterior of the electric oven, a cooking chamber 120 in the housing 100 for holding and cooking food, a component chamber 130 at one side of the cooking chamber 120, and a door 140 which forms a front of the housing 100 for selectively opening/closing the cooking chamber 120.

At predetermined locations within the cooking chamber 120, such as an upper surface and a bottom surface, there are an upper heater 121 and a lower heater 122 for heating and cooking food placed in the cooking chamber 120. In general, any suitable types of heaters, such as ceramic heaters, halogen heaters, or sheath grill heaters may be provided as the heaters 121, and 122.

On a rear surface of the inside of the cooking chamber 120, there may be provided a convection fan 123 for forcing an air flow in the cooking chamber 120 so as to transmit heat from the heaters 121 and 122 to the inside of the cooking chamber 120 uniformly.

Next, the component chamber 130 will be described.

The component chamber 130 may be provided within the housing 100 toward any suitable side of the cooking chamber 120, such as above, below, or to one side. The present invention will be described with regard to the component chamber 130 being provided above the cooking chamber 120.

Provided inside of the component chamber 130, there are a fan 160 for supplying heat to the inside of the cooking chamber 120, a suction duct 161 for guiding external air to an inside of the electric oven, an exhaust duct 162 for discharging the external air from the electric oven downwardly, and a PCB (printed circuit board) for controlling general functions of the electric oven. Any suitable types of components for operating the electric oven may be provided within the component chamber 130.

In front of the component chamber 130, there may be a control panel 131 connected to the electric components in the component chamber 130, with which the user may input and read operational parameters or functions of the electric oven.

The fan 160 in the component chamber 130 provides a suction force to the suction duct 161, for introducing external air to the suction duct 161 through the intake 103, and makes the air to flow toward the exhaust duct 162 forcibly for discharging the air to an outside of the electric oven range. The ducts 161, and 162 have ends in communication with the fan 160, and other ends opened between a top of the door 140 and a bottom of the control panel 131.

Figure 3:
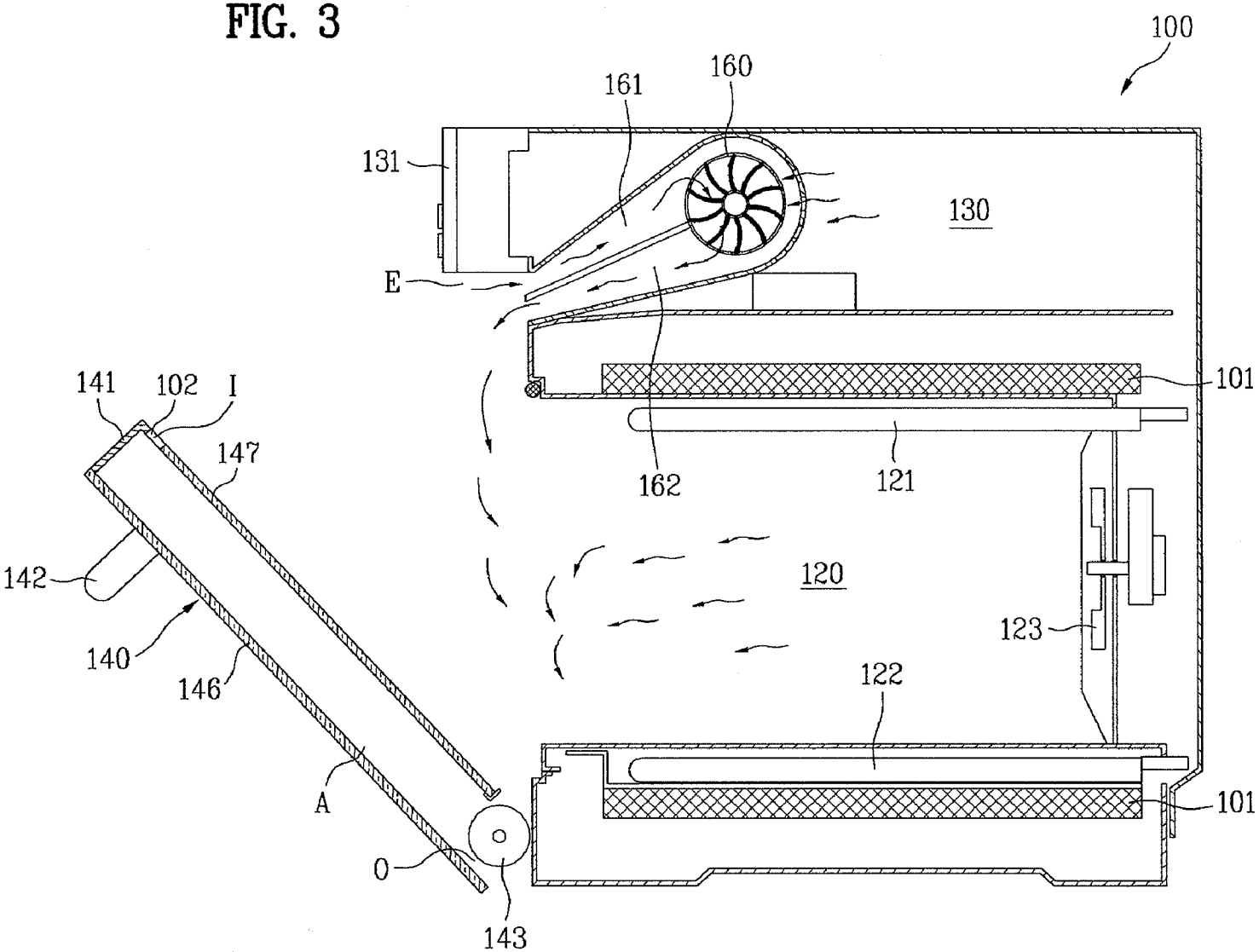
FIG. 3 is a longitudinal sectional view of the electric oven of FIG. 1 with the door opened.
Figure 4:
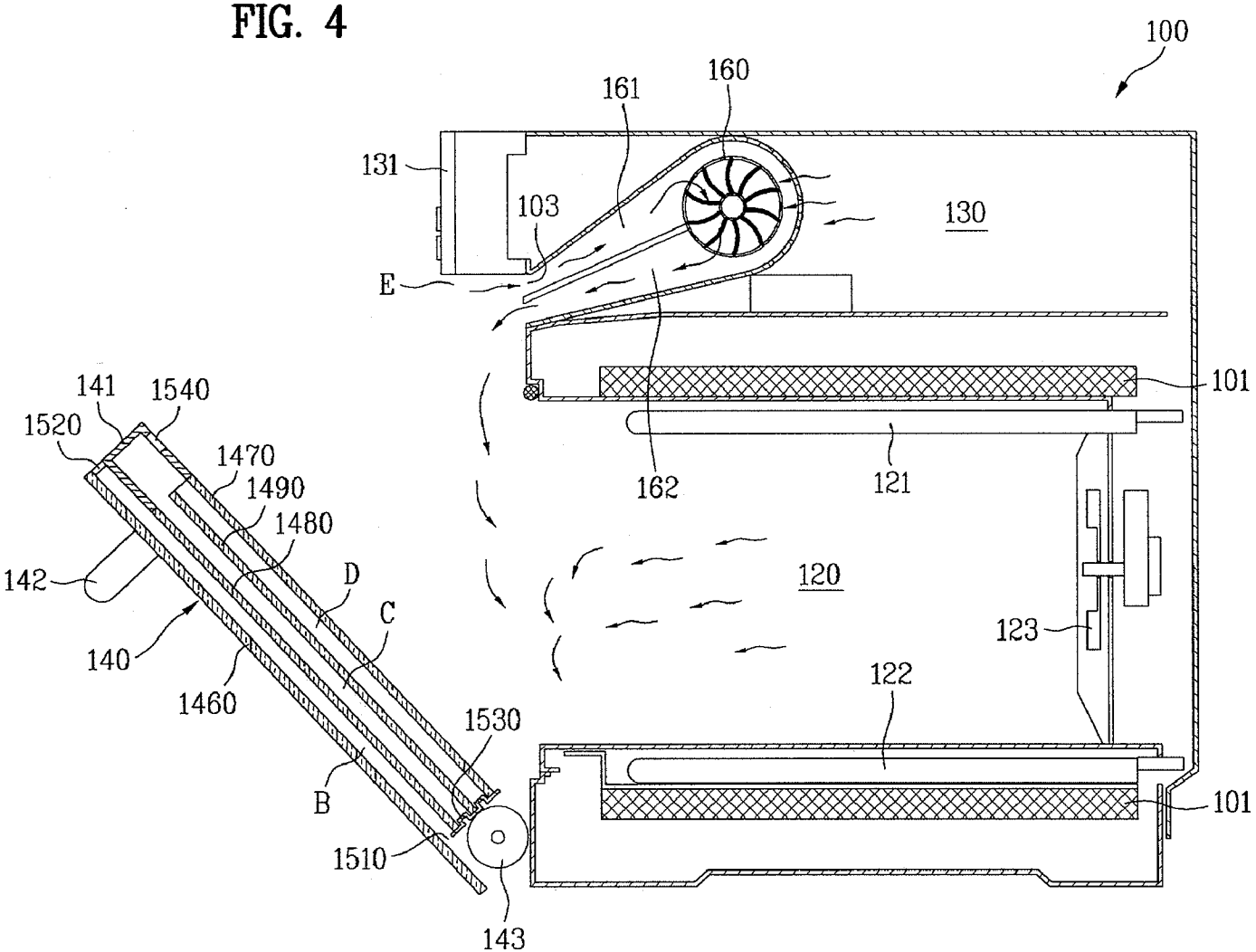
FIG. 4 is a longitudinal sectional view of the electric oven of FIG. 2 with the door opened.

Referring to FIGS. 3 and 4, the exhaust duct 162 has a front end sloped by a predetermined angle so that the air from the exhaust duct 162 is directed downwardly when the door 140 is opened. Of course, the entire exhaust duct 162 may be sloped.

Accordingly, the air from the exhaust duct 162 serves as an air curtain in front of the cooking chamber 120, to cut off the direct discharge of the high temperature, high pressure air toward the user when the door is opened.

Figure 2:
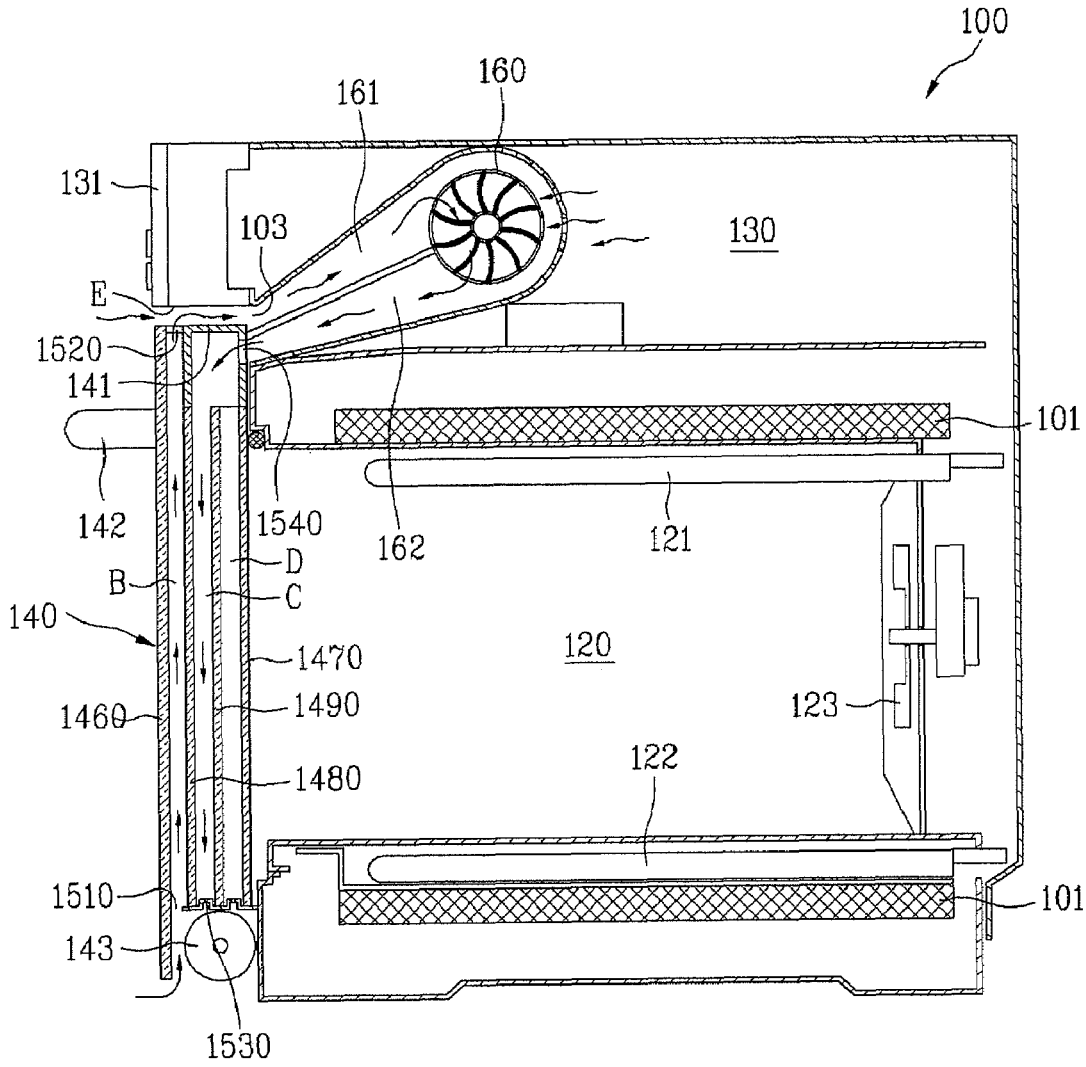
FIG. 2 is a longitudinal sectional view of an electric oven in accordance with a second embodiment of the present invention.

Referring to FIGS. 1 and 2, the other end of the suction duct 161 may be in communication with an inside of the door 140, which will be described in detail in a description of the door 140.

Referring to FIG. 1, in the first embodiment of the present invention the door 140 includes a door frame 141 forming an outside circumference and an exterior of the door 140, a handle 142 on an upper portion of the front of the door 140 for selective opening and closing of the door 140, and a hinge 143 for rotatably securing the door 140 to a lower portion of the body 100.

The door frame 141 may have a central portion constructed of a transparent member. The transparent member enables the user to look into the inside of the cooking chamber 120. The transparent member may be of any suitable material, such as glass. The glass may include an outer glass sheet 146 which forms an outside surface of the door 140, and an inside glass sheet 147 which forms an inside surface of the door 140. Provided inside of the door 140, there is a door flow passage A. The door flow passage A passes through the door 140 in an up/down direction for preventing heat from the inside of the cooking chamber 120 from being transferred to an outside of the electric oven. The door 140 has an inlet I at the top for introduction of air into the door flow passage A, and an outlet O at a bottom for discharge of the air from the door flow passage A.

Referring to FIG. 1, one end of the door flow passage A, i.e., the inlet I, is in communication with the forward end of the exhaust duct 161 which is in communication with the component chamber 130, so that the air flowing along the exhaust duct 161 can flow along the door flow passage A in the door 140.

Referring to FIG. 2, in the first embodiment of the present invention the glass of the door 140 has a plurality of overlapped sheets of glass 1460, 1470, 1480, and 1490, to form a plurality of door flow passages B, C, and D. In more detail, the sheets of glass 1460, 1470, 1480, and 1490 includes a sheet of an outer glass 1460 which forms an outside surface of the door 140, a sheet of an inner glass 1470, and at least one intermediate sheet of glass 1480, and 1490 between the outer, and inner sheets of glass 1460, and 1470.

In this embodiment, the intermediate sheet of glass includes two sheets of glass 1480 and 1490. A sheet of glass close to the outer sheet of glass 1460 may be called as a first intermediate sheet of glass 1480, and a sheet of glass close to the inner sheet of glass 1470 may be called as a second intermediate sheet of glass 1490. In the embodiment, though there are total four sheets of glass including the two intermediate sheets of glass, any suitable number of sheets of glass may be provided.

Inside of the door 140, there are a first flow passage B between the outer sheet of glass 1460 and the first intermediate sheet of glass 1480, and a second flow passage C between the first intermediate sheet of glass 1480 and the second intermediate sheet of glass 1490.

At a bottom of the first flow passage B, there is a first inlet 1510 formed, for introduction of external air into the first flow passage B. At a top of the first flow passage B, there is a first outlet 1520 formed for discharging air flowing along the first flow passage B to an outside of the first flow passage B.

In the meantime, at a bottom of the second flow passage, there is a second outlet 1530 formed for discharging air flowing along the second flow passage C to an outside of the second flow passage C. At a top of the second flow passage C, there is a second inlet 1540 for introduction of air into the second flow passage C.

A space between the second intermediate sheet of glass 1490 and the inner sheet of glass 1470 is enclosed to form a chamber D, for serving as a heat insulating chamber to prevent heat from the cooking chamber 120 from being transferred to an outside of the electric oven. By forming the space between the second intermediate sheet of glass 1490 and the inner sheet of glass 1470 as a perfect insulating space, the chamber D enhances a heat transfer prevention efficiency and minimizes a heat loss from the cooking chamber 120.

In the meantime, it is preferable that the flow passages B and C and the chamber D are not formed separately, but are formed utilizing spaces in the door 140, i.e., spaces between the sheets of glass 1460, 1470, 1480, and 1490. Particularly, it is preferable that the first and second flow passages B and C are formed such that the air can flow along between surfaces of the sheets of glass 1460, 1480, and 1490. This is for eliminating burning hazard to the user by making cold external air flow along the flow passages B and C to cool down the sheets of glass 1460, 1480, and 1490, even if the door 140 and the sheets of glass 1460, 1480, and 1490 are heated by heat transferred from the cooking chamber 120.

Referring to FIG. 2, the suction duct 161 is in communication with the first outlet 1520 of the first flow passage B so that the air flowing along the first flow passage B is guided to the suction duct 161 through the first outlet 1520. Of course, as shown in FIG. 2, the suction duct 161 can be made to be in communication with a third flow passage E to be explained later for drawing external air at the same time.

The exhaust duct 162 has one end in communication with the second inlet 1540 of the second flow passage C selectively so that the high temperature air being discharged along the exhaust duct 162 after circulating through the component chamber 130 is guided to the second flow passage C through the second inlet 1540, thereby preventing the high temperature air from being discharged forwardly of the cooking chamber 120.

In addition to the first flow passage A, there may be a third flow passage E between the door 140 and the control panel 131. The third flow passage E, a gap of a predetermined size between the top of the door 140 and the bottom of the control panel 131, may be provided for introduction of external air into the suction duct 161, so that comparatively cold external air is supplied to the component chamber 130 for enhancing cooling efficiency, and ensuring a certain amount of introduction of the external air thereto.

As the suction duct 161 has a forward end opened to the third flow passage E, and the first outlet 1520 of the first flow passage B of the door 140 is also opened to the third flow passage E, the external air introduced into the first flow passage B joins with the external air introduced into the third flow passage E, and is introduced into the suction duct 161. That is, the external air introduced through the first flow passage B incurs a small amount of temperature rise as the external air cools down the door 140 during introduction. By mixing the external air introduced through the first flow passage B with the external air introduced through the third flow passage E, a temperature of the external air introduced into the suction duct 161 can be reduced, and an adequate amount of external air can be secured since the external air is introduced through two flow passages. In this manner, the cold external air introduced through the bottom of the door 140 is guided to the suction duct 161 through the first flow passage B, flows from the fan 160 to the exhaust duct 162, and is discharged to an outside of the electric oven range through the second flow passage C.

As shown in FIGS. 1 and 2, it is preferable that the exhaust duct 162 is mounted under the suction duct 161 for arranging the suction duct 161 and the exhaust duct 162 in an up/down direction, and the ducts 161, and 162 are in communication with the flow passages A, B, and C in the door 140. Of course, the exhaust duct 162 may be mounted over the suction duct 161, in which, referring to FIG. 2, the external air is discharged through the first flow passage B between the outer glass 1460 and the first intermediate sheet of glass 1480, and the external air is introduced through the second flow passage C between the first intermediate sheet of glass 1480 and the second intermediate sheet of glass 1490.

In order to limit transmission of the heat from the cooking chamber 120 to an outside thereof, a gasket (not shown) is mounted along a front circumference of the cooking chamber 120 which is in contact with the door 140 to seal the circumference of the door 140 and the cooking chamber 120, for preventing heat from leaking from the cooking chamber 120 to an outside of the cooking chamber 120. Moreover, on an outside of the cooking chamber 120 a heat insulating material 101 is located for cutting off the transmission of the heat from the cooking chamber 120 to the outside thereof.

The operation of the electric oven range of the present invention will be described.

Referring to the first embodiment shown in FIG. 1, as the electric oven is put into operation with the door 140 closed, power is applied to the fan 160 to drive the fan 160.

When the fan 160 is driven, low temperature external air is introduced into the suction duct 161 through the third flow passage E between the door 140 and the control panel 131 by rotating force of the fan 160. The low temperature external air introduced into the suction duct 161 joins with high temperature air generated in the component chamber 130, and is discharged through the exhaust duct 162.

The air being discharged following the exhaust duct 162 is guided to the door flow passage A through the inlet I in the door 140, flows down along the door flow passage A, and is discharged downward through the outlet O of the door 140. Referring to FIG. 3, when the door 140 is opened, the external air introduced into the suction duct 161 by the operation of the fan 160 joins with the high temperature air generated in the component chamber 130, and is discharged through the exhaust duct 162.

However, since the forward end of the exhaust duct 162 is sloped downward, the air flows down following the exhaust duct 162, to form an air curtain as shown in FIG. 3. Since the forward end of the exhaust duct 162 is sloped downward, the high temperature air being discharged through the exhaust duct 162 does not flow to the user who opens the door 140, but moves down following the forward end of the exhaust duct 162 to form an air curtain which cuts off the high temperature, high pressure air being discharged from the inside of the cooking chamber 120 to the outside.

Referring to FIGS. 2 and 4, operation of the second embodiment of the invention will be described. As the electric oven range is put into operation with the door 140 closed, power is applied to the fan 160, to operate the fan 160.

When the fan 160 is operated, low temperature external air is introduced into the third flow passage E from forward of the electric oven range by rotating force of the fan 160, and from there into the suction duct 161 of the component chamber 130. Moreover, by the rotating force of the fan 160, the external air is also introduced through the first flow passage B of the door 140. The low temperature external air is introduced into the first flow passage B through the first inlet 1510 at the bottom of the door 140, and is discharged to the third flow passage E through the first outlet 1520 at the top of the door 140. Though the air discharged to the third flow passage E has a temperature relatively higher than the air introduced into the third flow passage E directly from an outside of the third flow passage E, it is relatively lower than the component chamber 130 where one end of the suction duct 161 is positioned.

The air introduced into the first flow passage B joins with the air introduced following the third flow passage E and can cool the component chamber 130. The high temperature air that has cooled the component chamber 130 is discharged following the exhaust duct 162 by rotating force of the fan 160.

The air being discharged following the exhaust duct 162 is introduced into the second flow passage C through the second inlet 1540, flows down following the second flow passage C, and is discharged to an outside of the electric oven through the second outlet 1530. In this instance, the air prevents the heat from transmitting to an outside of the electric oven range through the door 140 from the cooking chamber 120.

Referring to FIG. 4, even when the door 140 is opened, the external air introduced into the suction duct 161 joins with the high temperature air generated at the component chamber 130, and is discharged to the exhaust duct 162 by the operation of the fan 160. However, since the forward end of the exhaust duct 162 is sloped downward, the air flows downward following the exhaust duct 162 to form an air curtain as shown in FIG. 4. That is, because the fore end of the exhaust duct 162 is sloped downward, the high temperature air being discharged through the exhaust duct 162 does not flow toward the user who opens the door 140 directly, but moves downward to form an air curtain, to cut off the high temperature air being discharged to an outside of the cooking chamber 120 from the cooking chamber 120.

The electric oven may be provided with a suitable device (not shown) for sensing opening of the door 140. The fan 160 may be put into operation when the door 140 is opened by operation of such an open door sensing device, so that the air can be discharged from the exhaust duct 162 when the door 140 is opened.

It will be apparent to those skilled in the art that various modifications and variations can be made in the present invention. Thus, it is intended that the present invention covers such modifications and variations of the invention.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to exemplary embodiments, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified. Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. An electric oven comprising:

a housing having a cooking chamber for cooking food and a component chamber containing components for operating the electric oven;

a door on a front of the housing for selectively opening and closing the cooking chamber;

a suction duct for introducing external air from outside of the housing into the component chamber; and an exhaust duct having a sloped portion for discharging air from the component chamber to outside of the housing, wherein the door includes an air flow passage, the air flow passage having one end in communication with the exhaust duct and having an outlet formed at the other end of the air flow passage of the door for discharging air flowing along the air flow passage directly to the exterior of the oven.

2. The electric oven according to claim 1, wherein the exhaust duct supplies air toward the air flow passage when the door is in a closed condition, and supplies air toward a front of the cooking chamber when the door is in an opened condition.

3. The electric oven according to claim 1, wherein the door includes an inlet air flow passage for drawing in external air, and a discharge air flow passage for discharging air.

4. The electric oven according to claim 3, wherein the exhaust duct supplies air toward the discharge air flow passage when the door is in a closed condition, and supplies air toward a front of the cooking chamber when the door is in an opened condition.

5. The electric oven according to claim 3, wherein the inlet air flow passage supplies external air to the suction duct.

6. The electric oven according to claim 3, wherein the door includes glass sheets between which the inlet air flow passage and the discharge air flow passage are formed.

7. The electric oven according to claim 6, wherein the door further includes a sealed air chamber.

8. The electric oven according to claim 1, wherein the component chamber is positioned above the cooking chamber.

9. The electric oven according to claim 1, wherein the suction duct and the exhaust duct are located within the component chamber.

10. The electric oven according to claim 1, further comprising a fan in the component chamber for introducing air into the component chamber through the suction duct, and for discharging air from the component chamber through the exhaust duct.

11. An electric oven comprising:

a housing having a cooking chamber for cooking food and a component chamber containing components for operating the electric oven;

a door on a front of the housing for selectively opening and closing the cooking chamber; and an exhaust duct for discharging air from the component chamber to outside of the housing, wherein the door includes an air flow passage, the air flow passage having one end in communication with the exhaust duct and having an outlet formed at the other end of the air flow passage of the door for discharging air flowing along the air flow passage directly to the exterior of the oven.

12. The electric oven according to claim 11, wherein the exhaust duct supplies air toward the air flow passage when the door is in a closed condition, and supplies air toward a front of the cooking chamber when the door is in an opened condition.

13. The electric oven according to claim 11, further comprising a suction duct for introducing external air from outside of the housing into the component chamber, wherein the suction duct and the exhaust duct are located within the component chamber.

14. The electric oven according to claim 13, further comprising a fan in the component chamber for introducing air into the component chamber through the suction duct, and for discharging air from the component chamber through the exhaust duct.

15. An electric oven comprising:

a housing having a cooking chamber for cooking food and a component chamber containing components for operating the electric oven; and a door on a front of the housing for selectively opening and closing the cooking chamber, the door including an inlet air flow passage for drawing in external air, and a discharge air flow passage for discharging air directly to the exterior of the oven.

16. The electric oven according to claim 15, further comprising:

a suction duct for introducing external air from outside of the housing into the component chamber; and an exhaust duct for discharging air from the component chamber to outside of the housing.

17. The electric oven according to claim 16, wherein the exhaust duct supplies air toward the discharge air flow passage when the door is in a closed condition, and supplies air toward a front of the cooking chamber when the door is in an opened condition.

18. The electric oven according to claim 16, wherein the inlet air flow passage supplies external air to the suction duct.

19. The electric oven according to claim 16, further comprising a fan in the component chamber for introducing air into the component chamber through the suction duct, and for discharging air from the component chamber through the exhaust duct.

* * * * *